United States Patent [19]

Cobb

[11] 4,446,371

[45] May 1, 1984

[54] CORONA CHARGING APPARATUS

[75] Inventor: Harold W. Cobb, Acton, Mass.

[73] Assignee: Delphax Systems, Mississauga, Canada

[21] Appl. No.: 381,600

[22] Filed: May 24, 1982

Related U.S. Application Data

[63] Continuation-in-part of Ser. No. 244,833, Mar. 17, 1981, abandoned.

[51] Int. Cl.[3] ..... H01T 19/04

[52] U.S. Cl. ..... 250/324; 250/326

[58] Field of Search ..... 250/324, 325, 326; 361/229, 230, 213

[56] References Cited

U.S. PATENT DOCUMENTS 4,057,723 11/1977 Sarid et al. ..... 250/326
4,068,284 1/1978 Wheeler et al. ..... 361/230
4,086,650 4/1978 Davis et al. ..... 361/230
4,227,234 10/1980 Seanor et al. ..... 361/229

*Primary Examiner*—Bruce C. Anderson
*Attorney, Agent, or Firm*—Arthur B. Moore

[57] ABSTRACT

A corona charging device including a dielectric-coated elongate conductor embedded in a slot in a conductive member. A high voltage varying potential between the elongate conductor and slotted conductive member induces a glow discharge in a region of proximity of the two conductors. The slotted conductor may act as a grounding member to provide a corona discharge device with respect to a proximate surface. Alternately, the slotted conductor may be maintained at a desired potential to provide a charging device with an automatically limited voltage. The slotted conductor and dielectric-coated conductor may be replaced with alternative structures which provide an equivalent enclosure.

17 Claims, 10 Drawing Figures

FIG. 3
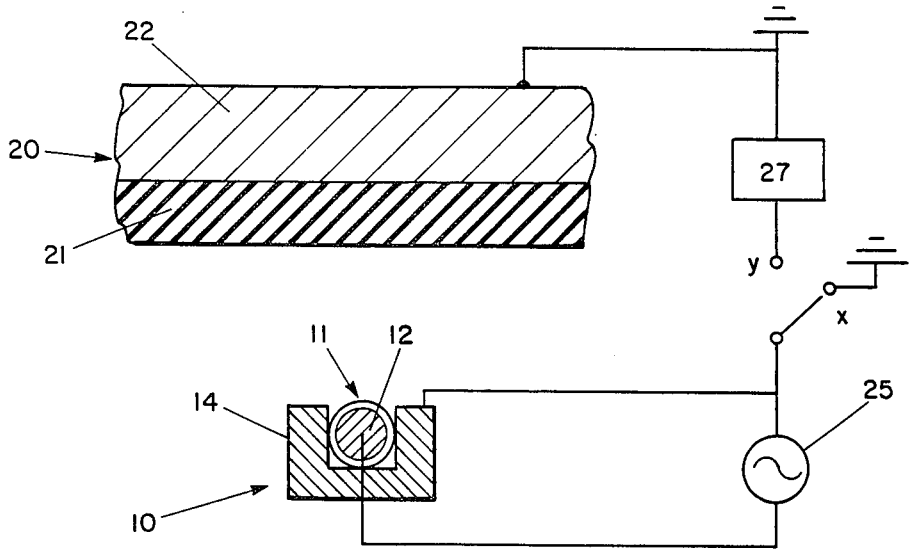
FIG. 4A
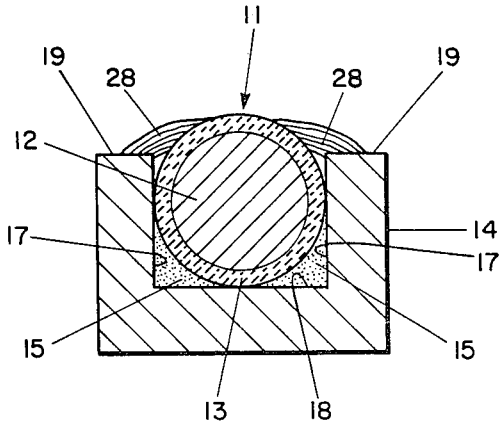
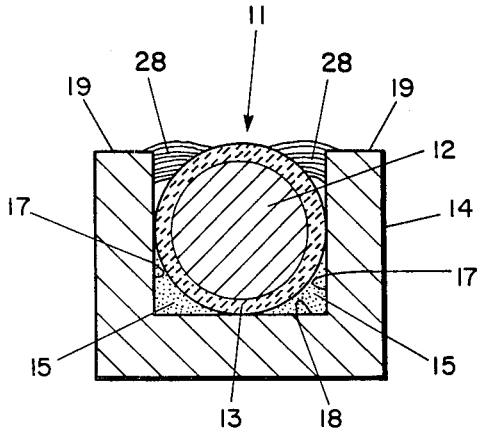
FIG. 4B

CORONA CHARGING APPARATUS

The present application is a continuation-in-part of U.S. patent application Ser. No. 244,833, filed Mar. 17, 1981 abandoned.

BACKGROUND OF THE INVENTION

The present invention relates to corona charging devices, particularly as used for discharging electrostatic images.

Corona charging devices in the form of thin conducting wires or sharp points are well known in the prior art. Illustrative U.S. Pat. Nos. are P. Lee, 3,358,289; Lee F. Frank, U.S. Pat. No. 3,611,414; A. E. Jvirblis, U.S. Pat. No. 3,623,123; P. J. McGill, U.S. Pat. No. 3,715,762; H. Bresnik, U.S. Pat. No. 3,765,027; and R. A. Fotland U.S. Pat. No. 3,961,574. Such devices are used almost exclusively in electrostatic copiers to charge photoconductors prior to exposure as well as for discharging. Standard corona discharges provide limited ion currents. Such devices as a rule achieve a maximum discharge current output on the order of 10 microamperes per linear centimeter, and require driving voltages on the order of tens of thousands of volts to achieve this output. At lower voltages these devices produce little or no output current. Additionally, corona wires are small and fragile, and easily broken. Because of their high operating potentials, they collect dirt and dust and must be cleaned or replaced frequently, in order to avoid the emission current fall off.

Corona discharges which enjoy certain advantages over standard corona apparatus are disclosed in Sarid et al., U.S. Pat. No. 4,057,723; Wheeler et al., U.S. Pat. No. 4,068,284; and Sarid, U.S. Pat. No. 4,110,614. These patents disclose various corona charging devices characterized by a conductive wire coated with a thick dielectric material, in contact with or closely spaced from a further conductive member. Various geometries are disclosed in these patents, all fitting within the above general description. These devices utilize an alternating potential in order to generate a source of ions, and a DC extraction potential. The patents disclose a preferred biasing range of 2000–6000 volts, relatively high values which are required in order to obtain significant extraction currents and therefore higher charging rates. These current outputs are exponential in character, in contrast to the fairly linear outputs of the present invention. U.S. Pat. No. 4,155,093 discloses ion generating apparatus which may be used for charge neutralization as well as deposition of net charge. This apparatus, which is difficult to fabricate, does not provide the high charging rates of the present invention.

Accordingly, it is a principal object of the invention to provide charging devices employing corona discharging which have superior performance compared with Prior art corona devices.

Another object of the invention is to provide a corona charging device which achieves high current densities. A related object is the achievement of high charging rates. Another related object is the avoidance of high biasing potentials in providing such charging rates.

A further object of the invention is to provide a charging device having a rugged and compact structure. A related object is to provide a device having a longer operational life than is customary in corona ion generators.

Still another object of the invention is the avoidance of emission current fall-off as the ion generator becomes slightly dirty. A related object is the achievement of uniform emission currents. Yet another object of the invention is the provision of a corona charging device with a reliable output potential.

SUMMARY OF THE INVENTION

In achieving the above and related objects, the invention provides a corona charging device comprising a support structure defining a slot in which a sheathed elongate conductor is placed. Sides of the support structure adjacent the conductor are conductive and the apparatus may be used for corona charging and discharging using a varying potential between the elongate conductor and the conductive sides of the support structure. These sides are maintained at ground potential for charge neutralization, and at a limiting bias potential for corona charging.

In accordance with various aspects of the invention, the support structure may have different cross sections. In the preferred embodiment, the support structure is a conductive beam in which the slot is formed, and the conductor is a cylindrical wire. In accordance with a related aspect, a variety of insulating materials, preferably inorganic, may be utilized in the dielectric sheath for the elongate conductor.

In an alternative embodiment of the invention, sides of the slot are formed by a pair of conductive bars mounted one on each side of the dielectric-coated conductor.

In accordance with yet other aspects of the invention, the various dimensions may be altered to modify the ion output characteristics of the corona charging and discharging device. Important parameters include: the lateral separation, if any, of the sheathed conductor from the sides of the support structure; the extent of protrusion or indentation of the sheathed conductor with respect to outer surfaces of these sides; and the width of the support structure as compared with the diameter of the sheathed conductor. Another important parameter is the separation of the device from the surface to be charged or discharged. In the preferred embodiment, the dielectric-sheathed conductor contacts the conductive sides of the support structure and protrudes slightly therefrom. Advantageously, the structure is only slightly broader than the width of the slot.

In still another embodiment of the invention a pair of dielectric-sheathed conductors lie in parallel, one to each side of a central conductive rod, all mounted against an insulating support. In a particular version of this embodiment, the dielectric-sheathed conductor comprises a glass capillary lined with an inner conductive layer. In all cases, the invention is advantageously characterized by discharge regions at or near the mouth of a slot.

In accordance with one further aspect of the invention, the varying potential is advantageously a continuous wave alternating potential in the range 600 to 1500 volts peak, with a frequency in the range 10 KHz to 10 MHz. Alternatively, the varying potential may comprise a pulsed voltage. In the embodiment for corona charging, the extraction potential preferably is on the order of tens or hundreds of volts.

The invention is preferably employed to erase electrostatic images from an adjacent dielectric member. Alternatively, the device is employed for charging such a dielectric member to a prescribed level. In the latter case, the device of the invention provides an automatic control over the charging level. In both embodiments, the corona device is advantageously disposed at a distance in the range 5–20 mils from the dielectric member.

BRIEF DESCRIPTION OF THE DRAWINGS

The above and additional aspects of the invention are illustrated with reference to the detailed description which follows, taken in conjunction with the drawings in which:

FIG. 3 is a sectional view of the corona device of FIG. 1, and including actuating electronics shown diagrammatically;

FIGS. 4A, 4B and 4C are sectional views showing various profiles which can be used in embodiments such as that shown in FIG. 1, and the associated air discharge regions:

DETAILED DESCRIPTION

Figure 1:
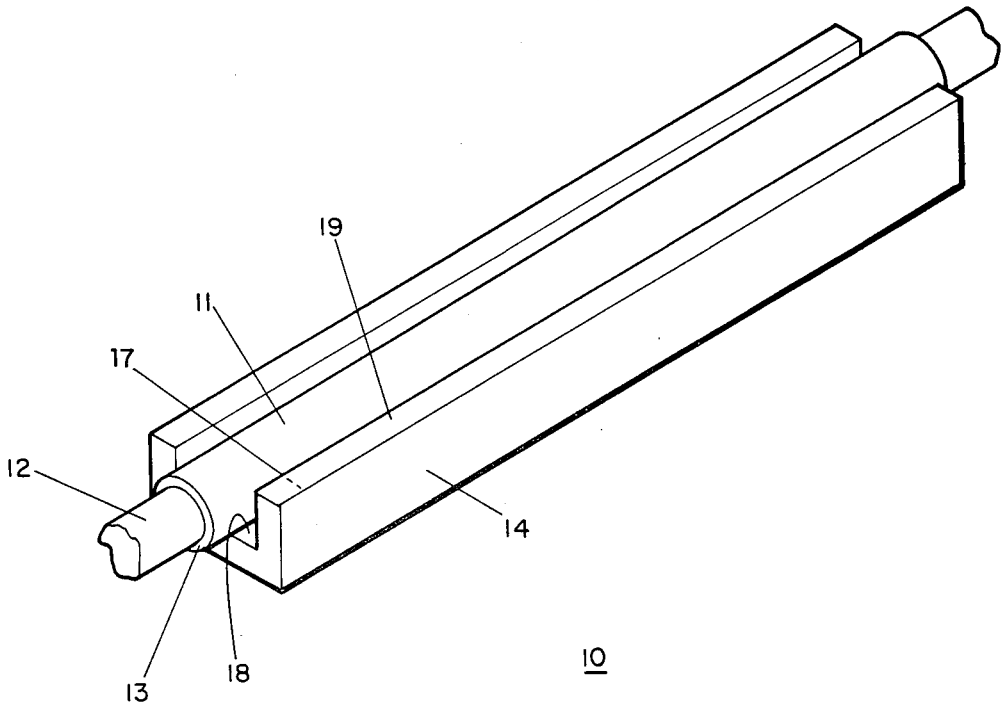
FIG. 1 respective view of a corona charging device in accordance with a preferred embodiment.

Reference is made firstly to FIGS. 1 to 3 and 4A for a detailed description of the preferred embodiment. An ion generator 10 (sometimes also called a corona device) includes a corona electrode 11, which is contained in a slot 16 (FIG. 2) in a support structure in the form of a conductive beam 14. A characteristic feature of the corona device of the invention, illustrated in FIG. 1, is that the corona electrode 11 and conductive beam 14 form a linear structure. Although in this the preferred embodiment, a unitary conductive member 14 is illustrated, this member may be replaced by alternative structures forming an equivalent conductive enclosure (see FIG. 5).

Corona electrode 11 consists of a conductor 12 in the form of a conductive wire (which may comprise any suitable conductor) encased in a layer 13 of dielectric material. Although a dielectric-coated cylindrical wire is illustrated in the preferred embodiment, the electrode 11 is more generally described as an elongate conductor of indeterminate cross-sectional shape, with a dielectric sheath. The dimensions of the various structures are chosen to provide desired operational characteristics of the ion generator 10, as further described below. Significant features of the device in this description include the sides of the beam 14 which define respective side walls 17, and the base 18 of slot 16, as well as the similar outer surfaces 19 adjacent the slot.

Figure 2:
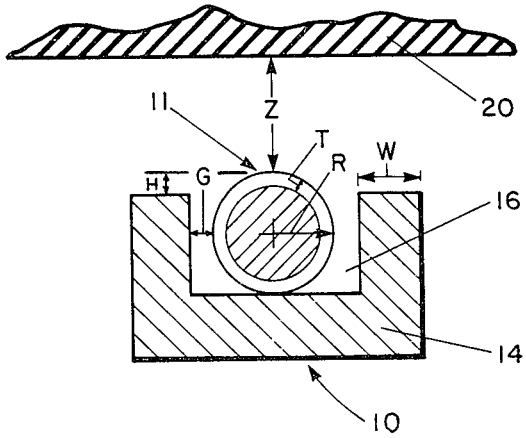
FIG. 2 is a sectional schematic view of the corona device of FIG. 1 in proximity to an imaging surface.

FIG. 2 shows the corona device of FIG. 1 as seen in section, in proximity to an imaging member 20. A number of dimensions are important in describing this device in structural terms. These include the outside radius R of the corona electrode 11, and the thickness T of the dielectric layer 13; the minimum separation G (if any) of the corona electrode from the side walls 17 which is located intermediate the depth of the slot; the width of that portion of the beam 14 at each side of slot 16; the protrusion H of the corona electrode from slot 16 (the corona electrode 11 may be inset from the outer surface, in which case H is negative); and the gap Z between the corona device 10 and the imaging surface 20. In constructing a device 10 in accordance with these parameters, it is generally desirable that G=0, that W be given a minimal value consistent with structural integrity, and that H have a small positive value as compared with the magnitude of R. As used in the specification and claims, the description "substantially in contact" indicates a separation G of zero within reasonable mechanical tolerances, i.e. of an order of magnitude smaller than the corona electrode diameter R. These preferred values provide superior performance characteristics as discussed in detail below. Of course if G is not equal to zero some support must be provided to locate the electrode centrally in the slot 16. Suitable fillers such as filler 15 (FIG. 4A) can be used for this purpose.

FIG. 3 is a sectional view of a particular arrangement of the device 10 with separation G=0 and deployed for corona charging and neutralizing near an imaging member 20 consisting of a dielectric layer 21 with a conductive backing 22. The device 10 is actuated for the generation of ions by application of a time-varying potential 25 between the elongate conductor 12 and the conductive beam 14. The potential 25 induces the formation of a pool of positive and negative ions in an air space at the vicinity of the upper surface of electrode 11, as shown in detail in FIGS. 4A–4C. This phenomenon is herein termed "glow discharge". With a periodically varying potential 25, air gap breakdown occurs during each half cycle if the excitation potential exceeds approximately 1400 volts peak-to-peak, for a dielectric thickness in the range of 2–3 mils. (i.e. 0.002 to 0.003 inches). The dielectric 13 will receive a net charge, thereby extinguishing the discharge, and preventing the direct flow of in-phase current between the conductive beam 14 and elongate conductor 12.

With the switch in position X (FIG. 3), the ion generator 10 acts as a charge neutralizing device with respect to an electrostatic image carried on the dielectric surface 21 of FIG. 3. As also seen in FIG. 3, the conductive beam 14 and the conductive backing 22 are grounded. The electrical behavior of this device may be measured as a plot of output current, i, as a function of the voltage V between the surface of layer 21 and conductive beam 14. Typically, the devices of this invention are characterized by roughly linear i-V curves. It is preferable to have a low offset voltage $V_O$, i.e. that voltage which, as the voltage drops, i=0.

If the dielectric surface of layer 21 carries any net positive or negative charge, this charge will establish an electrical field to conductive beam 14, causing the extraction of ions of the opposite polarity from the ion pool. If the ion generator 10 is thus disposed for a sufficient period of time, the surface of layer 21 will be completely neutralized. Dielectric layer 21 bears little or no residual surface charge under these circumstances. Another desirable feature is that of the typically high discharge rates of this device.

Advantageously, the corona device is disposed at a distance in the range 5–20 mils from the surface of layer 21, most preferably around 15 mils, as measured from the outer surface of corona electrode 11. A further advantage of the invention is that the offset voltage of this device is relatively insensitive to changes in gap width within this range. The corona device may be operated for extended periods with minimal servicing requirements and it is quite robust to permit cleaning.

With further reference to FIG. 3, the device 10 may be utilized to deposit a net positive or negative charge on the surface of layer 21 when the switch is at position Y. This places a DC bias potential 27 on conductive beam 14. With a positive bias to beam 14, for example, a positive charge of equal magnitude can be deposited on the surface of layer 21. When operated in this mode, the corona device 10 provides automatic limiting of the charging potential.

In a preferred utilization of the corona device 10, a relative motion is provided between the device 10 and the imaging member 20 so that the device will effectively scan the surface of layer 21. This layer may comprise, for example, the surface of a rotatable drum with a dielectric or photoconductive surface. The corona device 10 may be employed either for charging or discharging with the electrophotographic apparatus of U.S. Pat. No. 4,195,927 and for charge neutralization in the electrostatic printing apparatus of co-pending application Ser. No. 222,829, which is a continuation-in-part of Ser. No. 969,517, in turn a continuation-in-part of Ser. No. 844,913. It is generally desirable to minimize variations of the separation Z during such relative motion. When operating the corona charging mode during such motion, the device will generally provide a surface potential which is a fraction of the bias potential; this fraction will increase with lower surface speeds.

In the preferred embodiment, time-varying potential 25 comprises a high frequency, high voltage sinusoid. Preferably excitation potential 25 has a magnitude in the range 1700–2500 volts peak-to-peak, illustratively around 2000 volts peak-to-peak. Excitation potential 25 may comprise a continuous wave alternating potential, advantageously of a frequency in the range 10 KHz to 1 MHz. Driving voltages at higher frequencies have been observed to cause overheating of the corona device, while lower frequency waveforms may provide inadequate output currents. A continuous wave frequency of 100 KHz provides desirably high output currents without a serious risk of overheating device 10. Alternatively, excitation potential 25 may comprise a pulsed voltage which can be specified by the parameter of peak-to-peak voltage, repetition period, pulse width, and base frequency. The device 10 has been operated at frequencies as high as 1 MHz applied in short bursts with a duty cycle near 10 percent.

The dielectric layer 13 should have sufficient dielectric strength to withstand high excitation potentials without dielectric breakdown. It is desirable to minimize the onset voltage; i.e., the excitation voltage at which the dielectric begins to charge. This onset voltage increases with the thickness of dielectric layer 13, and increases with lower dielectric constants of that layer. Organic dielectrics are generally unsuitable for this application, as most such materials tend to degrade with time due to oxidizing products formed in atmospheric electric discharges. In the preferred embodiment, the dielectric layer 13 comprises a fused glass which is fabricated in order to minimize voids, having a thickness in the range 1–3 mils. Other suitable materials include, for example, sintered ceramics and mica.

Figure 4C:
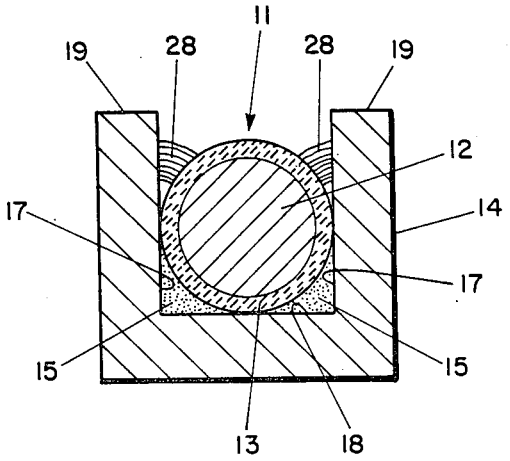

With reference to the partial sectional view of FIGS. 4A–C, the relationship between the parameter H (protrusion) shown in FIG. 2 and the configuration of discharge regions 28 is seen with respect to a variety of alternative profiles of device 10. In these Figures the same numerals are used for corresponding parts. In all of these profiles, separation G =0, and width W is constant. If the electrode 11 protrudes prominently from the slot, as shown in FIG. 4A, the discharge regions 28 will largely encompass the outer surfaces 19 of beam 14. The discharge regions 28 are generally determined by the Paschen limits between elongate conductor 12 and conductive beam 14. With discharge regions 28 of the characteristics shown in FIG. 4A, there will be considerable inefficiencies in the operation of the device 10 due to loss of ions to the outer portions of upper surface 19, which acts as a ground plane. This will lead to a diminishing of the ion output current. In the configuration of FIG. 4B, the corona electrode 11 protrudes only slightly from the slot. In this case, the discharge regions 28 comprise regions at the outer portions of the approximately V-shaped spaces defined by the outer parts of the two side walls 17 and an exposed portion of the dielectric layer 13. These areas are the optimal locations for the ion pools, in that they provide a readily extractable source of ions, with minimal ion current loss due to diversion of ions. If, on the other hand, the corona electrode 11 is housed considerably below the upper surface 19, (i.e. so that H is negative) as shown in FIG. 4C, the discharge regions 28 will be inset from the surface of slot 16. This will incur the disadvantages that the ions will not be as easily extractable, and that there will be inevitable ion current loss due to diversion to the upper portions of side walls 17.

In the preferred construction of the corona device of the invention, a filler is included in the inner regions of the slot as seen in FIGS. 4A–4C where an adhesive filler 15 is contained between dielectric layer 13 and base 18. The use of a filler prevents power losses due to air breakdown in these regions, and reduces the risk of dielectric breakdown due to the heating in these lower regions. Such air breakdown would be similar in form to that depicted in FIGS. 4A–C, but would not provide a useful source of ions.

It may be seen with reference to FIGS. 4A–4C that a minimal value for the width W of outer surfaces 19 is desirable in order to avoid ion current loss, and that a small positive value of protrusion H is preferred in order to provide a desirable location for the discharge regions 28.

It is also advantageous to place the corona electrode in contact with the side walls 17 (i.e. separation G=0) in order to avoid erratic behavior in the operation of the device. This characteristic poses difficulties in the embodiment of FIGS. 1–4 in keeping the dielectric-coated electrode in contact with the side walls throughout the length of the device.

Figure 5:
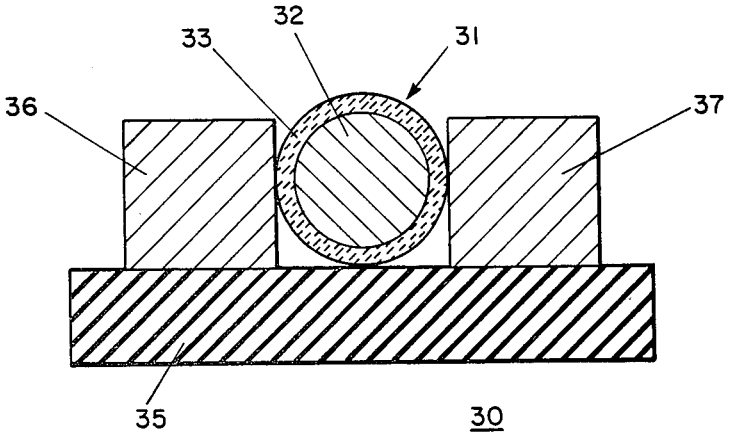
FIG. 5 is a sectional view of a corona charging device in accordance with an alternative embodiment of the invention.

Reference is next made to FIG. 5 which is a sectional view of a corona device 30 in accordance with an alternative embodiment, wherein this difficulty is overcome. In the corona device 10', the slotted conductive beam 14 of FIG. 1 is replaced with support structure including a pair of conductive bars 36 and 37, forming the sides, and an insulating base 35 on which the bars are mounted. Although they are illustrated with square cross sections the bars 36, 37 are generally rectangular in cross section. The dielectric-coated electrode 31 is contained in a slot formed by top of the insulating base 35 and the side walls of the bars 36, 37. These bars are flexible metallic structures which may be conformed to the outer surface of the dielectric layer 33 of the electrode 31 throughout its length, thereby ensuring that G will be negligible for the entire length of the device.

The embodiment of FIG. 5 may be further modified by altering the special arrangement of the various parts forming the ion generator. In the sectional view of FIG. 6, a pair of square-sectioned and dielectric-coated elongate electrodes 42, 46 lie in parallel, one to each side of a central conductive rod. Illustratively, the conductive rod comprises a thick cylindrical wire 41, and each of the dielectric-coated electrodes 42 and 46 comprise glass capillaries 44, 48 of rectangular cross section filled with metallic cores 43, 47. Desirably, the metallic core material is characterized by a low melting point, and has a coefficient of expansion which is compatible with that of the capillary material. As in the case of the device 30 of FIG. 5, the charging device 40 is fabricated by mounting the wire 41, and electrodes 42, 46 on an insulating base 45 such that these electrodes closely conform to each other throughout the length of the device. The corona device 40 is actuated by applying varying potentials between each of the respective metallic cores 43 and 47 and the wire 41 forming the central electrode.

Figure 6:
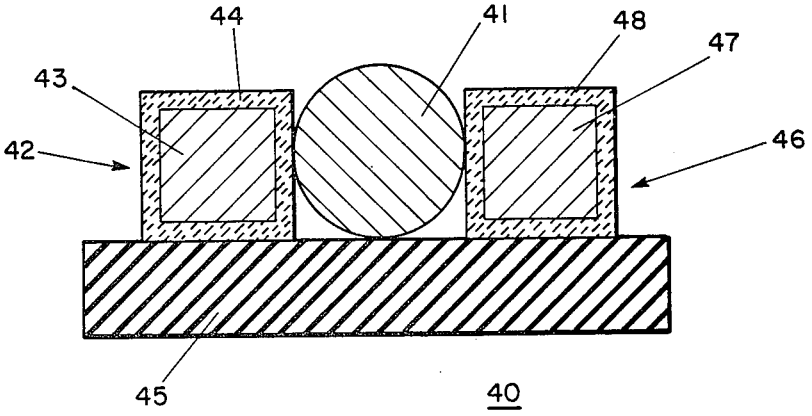
FIG. 6 is a sectional view of a corona charging device in accordance with a further alternative embodiment of the invention.
Figure 7:
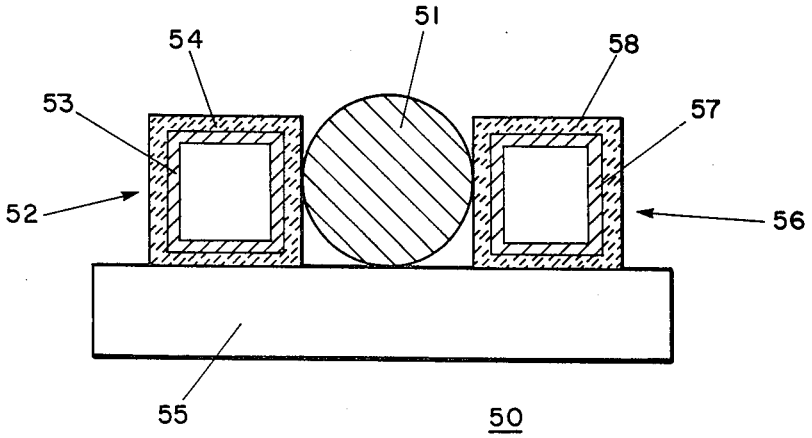
FIG. 7 is a sectional view of a corona charging device in accordance with yet another embodiment of the invention.

FIG. 7 illustrates a modified version 50 of the device of 40 of FIG. 6 having a conductive rod or wire 51 between electrodes 52, 56 supported on a base 55. In corona device 50, the glass capillaries 54, 58 are not completely filled with a metallic core, but instead are lined internally with metallic layers 53, 57 of sufficient thickness to conduct the energizing current. Suitable metals for the core structures of FIGS. 6 and 7 include for example low melting alloys of bismuth, and indium alloys.

Figure 8:
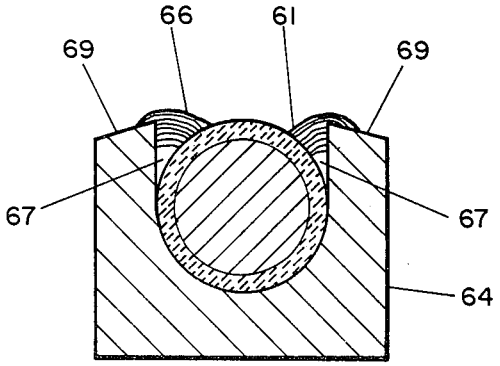
FIG. 8 is a view similar to FIG. 7 of still another embodiment.

Yet another embodiment is shown in FIG. 8 which illustrates a further variable in the cross-sectional shape of the support structure. In this view a conductive elongate beam 64 straddles a corona electrode 61 which is seated snugly in a slot 66 shaped to receive the cylindrical electrode. A pair of similar surfaces 69 are provided at the outer extremities of side walls 67 which are the inner surfaces of the sides of the beam. The surfaces 69 differ from corresponding surfaces of other embodiments in that they are not coplanar but lie in planes which converge at a line equidistant from the two side walls 67. Such variations in the geometry of the structure are within the scope of the invention.

It will be evident that in all of the embodiments described, pools of available ions can be formed to either side of the corona electrode in the spaces provided between the exposed position of the electrode in the mouth of the slot, and the adjacent conductive sides of the slot containing the electrode.

The invention is further illustrated in the following non-limiting examples:

EXAMPLE 1

A corona charging device of the type shown in FIG. 1 was constructed as follows. The corona electrode consisted of a 7 mil diameter stainless steel wire having a 2 mil thick glass coating. The coated wire was seated centrally in an 11 mil wide, 10 mil deep rectangular slot in a stainless steel beam of total dimensions 50 mil deep, after first inserting adhesive filler at the bottom of the slot. This provided outer surfaces 19 of 19.5 mil on each side of the slot 16.

A 100 KHz, 2000 volt peak-to-peak continuous wave alternating potential was placed between the coated wire and the steel beam. The outer surface of the corona electrode was located 15 mils from the surface of an imaging drum having a thin photoconductive surface layer, which a capacitance of 100 picofarads per $cm^2$. The imaging drum was rotated at a surface speed of 25 cm/second relative to the corona device, and was charged to 500 volts by imposing a 1000 volt direct current potential between the steel beam and the drum's conductive core. This represented an average corona output current of 40 micro-amperes per centimeter length of corona.

EXAMPLE 2

The apparatus of Example 1 was employed as a corona discharge device by grounding the steel beam to a photoreceptor drum's conductive core. In this mode, the device neutralized electrostatic images at rates comparable to the charging rates of Example 1, leaving virtually no residual electrostatic image.

EXAMPLE 3

The apparatus of Example 1 was modified as follows to provide a corona charging device of the type shown in FIG. 5. A glass-coated tungsten wire as in Example 1 was bonded to an insulating support consisting of glass epoxy G-10 laminate. Two tantalum wires of 10 mil×10 mil square cross-sections were bonded to the base on either side of the glass-coated wire, contacting the dielectric sheath along their lengths.

This apparatus exhibited equivalent performance to the structure of Example 1, in both the charging and neutralizing modes.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Apparatus for generating ions, the apparatus comprising:

a corona electrode having an elongate conductor and a dielectric layer coating the conductor;

an elongate support structure defining a slot containing and supporting the corona electrode, the support structure including a base and electrically conductive sides having respective side walls which are substantially in contact with the corona electrode, a portion of the dielectric layer being exposed along the length of the slot; and a time-varying potential between the corona electrode and the electrically conductive sides for creating a glow discharge to form ions in an air region adjacent the exposed portion of the dielectric layer and said side walls.

2. Apparatus as claimed in claim 1 in which the corona electrode is substantially in contact with the side walls intermediate the depth of the slot.

3. Apparatus as claimed in claim 1 in which the support structure is an electrically conductive beam.

4. Apparatus as claimed in claim 1 in which the base comprises a dielectric member which is coupled to the conductive sides.

5. Apparatus as claimed in claim 1 in which the sides are bars.

6. Apparatus as claimed in claim 1 in which the corona electrode protrudes outwardly beyond extremities of said side walls.

7. Apparatus as claimed in claim 1 in which the sides include outer surfaces forming corners with respective side walls.

8. Apparatus as claimed in claim 7 in which the corona electrode protrudes outwardly beyond the outer surface of said sides.

9. Apparatus as claimed in claim 7 in which the said outer surfaces are narrow when compared with the width of the slot.

10. Apparatus as claimed in claim 1 in which the dielectric layer has a thickness in the range 1–3 mils.

11. Apparatus as claimed in claim 1 in which the dielectric layer is of an inorganic dielectric material.

12. Apparatus as claimed in claim 11 in which the inorganic dielectric material is a material selected from the class consisting of glass, mica, and sintered ceramic material.

13. Apparatus for generating ions, the apparatus comprising:

an elongate base of dielectric material extending axially;

an elongate first electrode in contact with the base;

a pair of elongate second electrodes supported by the base and extending axially one to either side of the first electrode;

dielectric material extending axially between the first electrode and both of the second electrodes, wherein said dielectric material encases one of (a) the first electrode, and (b) each of the second electrodes; and is substantially in contact with and outwardly diverging from the other of (a) and (b), to define an air region;

a time-varying potential between said first electrode and said pair of second electrodes for creating a glow discharge to generate a pool of ions in said air region.

14. Apparatus for generating ions comprising:

an elongate conductor;

a dielectric sheath for said elongate conductor;

a conductive enclosure for the sheathed elongate conductor, wherein said conductive enclosure includes inner walls proximately straddling or surrounding the sheathed elongate conductor with approximately zero gap therebetween, and further includes an opening to expose a surface portion of the sheathed elongate conductor coextensive with its axis; and a varying potential applied between said elongate conductor and said conductive enclosure in order to create a glow discharge.

15. The method of generating ions which comprises the steps of:

providing a corona device comprising an elongate conductor, a dielectric sheath of the elongate conductor, and a conductive enclosure for the elongate conductor and dielectric sheath including inner walls proximately straddling or surrounding the elongate conductor with approximately zero gap therebetween, and an opening to expose a surface portion of the dielectric sheathed elongate conductor coextensive with its axis; and applying a varying potential between the elongate conductor and the conductive enclosure in order to create a glow discharge.

16. A method of generating ions which comprises the steps of:

providing a device for generating ions comprising a corona electrode having an elongate conductor and a dielectric layer coating the conductor, an elongate support structure defining a slot containing and supporting the corona electrode, the support structure straddling the electrode and including a base and electrically conductive sides having respective side walls adjacent the electrode intermediate the depth of the slot, the corona electrode being substantially in contact with the side walls of the support structure, and a portion of the dielectric layer being exposed along the length of the slot; and applying a time-varying potential between the corona electrode and the sides of the support structure to create a glow discharge resulting in pools of ions in an air region adjacent the conductive sides and the dielectric layer.

17. Apparatus as defined in claim 1 in which the air regions comprise outwardly enlarging spaces defined by said side walls and the corona electrode.

* * * * *